US009156659B2

(12) United States Patent
Teixeira Pinto Dias

(10) Patent No.: US 9,156,659 B2
(45) **Date of Patent: *Oct. 13, 2015**

(54) ELEVATOR SHAFT DOOR FRAME INCLUDING ELEVATOR CONTROL

(75) Inventor: Manuel Teixeira Pinto Dias, Locarno (CH)

(73) Assignee: Inventio AG, Hergiswil (CH)

( * ) Notice: Subject to any disclaimer, the term of this patent is extended or adjusted under 35 U.S.C. 154(b) by 724 days.

This patent is subject to a terminal disclaimer.

(21) Appl. No.: 13/483,303

(22) Filed: May 30, 2012

(65) Prior Publication Data

US 2012/0304550 A1 Dec. 6, 2012

(30) Foreign Application Priority Data

May 30, 2011 (EP) ..... 11168023

(51) Int. Cl.
*B66B 13/14* (2006.01)
*B66B 13/30* (2006.01)
*B66B 11/00* (2006.01)

(52) U.S. Cl.
CPC ..... *B66B 13/306* (2013.01); *B66B 11/001* (2013.01)

(58) Field of Classification Search
CPC ..... B66B 11/001; B66B 13/306
USPC ..... 187/251, 272, 277, 314, 316, 391, 414
See application file for complete search history.

(56) References Cited

U.S. PATENT DOCUMENTS

| | | | | |
|---|---|---|---|---|
| 5,740,888 | A * | 4/1998 | Aulanko et al. | 187/336 |
| 6,230,845 | B1 * | 5/2001 | Yamakawa et al. | 187/391 |
| 6,336,523 | B1 * | 1/2002 | Ozeki et al. | 187/391 |
| 6,378,660 | B1 * | 4/2002 | Adifon et al. | 187/272 |
| 6,484,850 | B1 * | 11/2002 | Kobayashi et al. | 187/414 |
| 6,488,129 | B2 * | 12/2002 | Lamb | 187/414 |
| 7,114,594 | B2 * | 10/2006 | Rossignol et al. | 187/336 |
| 7,398,861 | B2 * | 7/2008 | Rossignol et al. | 187/314 |
| 2012/0305337 | A1 * | 12/2012 | Hopp et al. | 187/336 |
| 2014/0224591 | A1 * | 8/2014 | Garcia | 187/251 |

FOREIGN PATENT DOCUMENTS

| | | | |
|---|---|---|---|
| EP | 0680921 | A2 | 11/1995 |
| EP | 1046604 | A1 | 10/2000 |
| EP | 1562849 | A1 | 8/2005 |
| JP | 2004-250210 | A | 9/2004 |
| WO | 2004/046010 | A1 | 6/2004 |
| WO | WO 2010070378 | A1 * | 6/2010 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator shaft closure, which separates an elevator shaft of a building from a story of the building, has a door frame. An elevator control arrangement is arranged in a chamber of the door frame, wherein the elevator control arrangement includes an elevator control unit and at least one electronic power unit for operation of an elevator motor.

18 Claims, 7 Drawing Sheets

20 ELEVATOR CONTROL UNIT
21 ELECTRONIC POWER UNIT
20.1, 21.1 COOLING BODIES
20.2, 21.2 CIRCUIT BOARDS 20.8, 21.8 SENSOR
25 FAN
26 REGULATING DEVICE 18.4 Power Supply Unit
20 Elevator Control Unit
21 Electronic Power Unit
31 Story Control Panel
33 Second Electronic Power Unit
38 Elevator Control Arrangement 20 Elevator Control Unit
20.8 Temperature Sensor
21 Electronic Power Unit
21.8 Temperature Sensor 45 First Fan
46 Second Fan
48 Elevator Control Arrangement

ELEVATOR SHAFT DOOR FRAME INCLUDING ELEVATOR CONTROL

CROSS-REFERENCE TO RELATED APPLICATION

This application claims priority to European Patent Application No. 11168023.7, filed May 30, 2011, which is incorporated herein by reference.

FIELD

The disclosure relates to an elevator door frame.

BACKGROUND

In some cases, an elevator shaft closure of a building comprises a door frame, which is fastened in the building, and movable doors. The elevator shaft closure separates an elevator shaft of the building from a story of the building, wherein an elevator control arrangement is arranged in a chamber of the door frame. The disposition of the elevator control arrangement within the door frame is made possible, inter alia, by the fact that the elevator control arrangement can nowadays be of smaller construction and the power consumption as well as the resulting waste heat could be reduced and thereby, for example, ventilating installations are not required. An elevator control arrangement comprises, for example, an elevator control unit and means for mounting and for protection of the elevator control unit. The elevator control arrangement is therefore mountable and demountable as an entire unit with few handling operations in an elevator installation.

The elevator control unit substantially comprises subassemblies required for control and/or regulation of the elevator installation. Moreover, such an elevator control unit can contain interfaces and input modules necessary for servicing of the elevator installation and for diagnostics and comprise a power supply unit for voltage supply.

Door frame elements of elevator installations should usually not, as a consequence of their dimensions, be dominant in appearance and therefore have very small cross-sections. In existing elevator installations the dimensions of the cross-section are seldom more than 0.1 meters×0.15 meters.

In addition, an electronic power unit, which is usually arranged in the elevator shaft, is usually necessary for operation of an elevator motor. The elevator motor, which is similarly arranged in the elevator shaft, can be connected by way of the electronic power system with the power supply unit and is activated by control signals of the elevator control unit.

SUMMARY

A door frame of an elevator shaft closure comprises a chamber in which an elevator control arrangement is arranged. The elevator shaft closure separates an elevator shaft of a building from a story of the building. In at least some embodiments, the elevator control arrangement includes an elevator control unit and at least one electronic power unit for operating an elevator motor.

The construction of the chamber or the very limited volume thereof depends on the selection of the profile cross-sections which the door frame elements have. Insofar as the door frame is formed from tubular sections, the chamber is arranged in the interior of the door frame profile. Insofar as a door frame is formed from angle sections and/or U-profiled sections, a side wall of the chamber can also be formed by the masonry of the building. In order to facilitate maintenance the elevator control arrangement is usually installed in a vertical door frame element or in the door post.

In elevator installations the drive is often arranged in the elevator shaft itself. Mostly in elevator installations of that kind the elevator control arrangement is disposed in a region of an elevator shaft closure, whilst the electronic power unit, which usually is part of a frequency converter, is arranged in the elevator shaft in the vicinity of the drive. This is because electronic power units often generate considerable levels of waste heat. In addition, the electrical and/or magnetic fields or electrical and/or magnetic waves of the electronic power units can cause appreciable disturbances in the elevator control unit.

However, through the arrangement of the electronic power unit in the elevator shaft maintenance thereof is sometimes made difficult by comparison with maintenance of the elevator control unit. Moreover, due to this arrangement a substantial outlay on material arises, since the elevator control unit needs an individual power supply. Moreover, the installation outlay is considerable due to this arrangement, since substantially more cable has to be laid between the elevator control arrangement, the electronic power system and the elevator motor.

The electronic power unit for operation of an elevator motor is possibly part of an electronic frequency converter. In principle, the electronic (static) frequency converter comprises a rectifier, which supplies a direct-current or direct-voltage intermediate circuit and a DC-AC converter supplied by this intermediate circuit as well as further electronic parts, for example to control the DC-AC converter. The intermediate circuit consists of a capacitor for smoothing the direct voltage and an inductance for interference suppression. As rectifier use is in that case made of not only uncontrolled, but also controlled bridges. The power supply of the intermediate circuit can in the case of use of a controlled bridge also be carried out by an active power factor correction (PFC). The DC-AC converter operates exclusively with electronic power switches (controlled bridges). These can be, inter alia, transistors such as metal-oxide semiconductor field effect transistors (MOSFETs), insulated gate bipolar transistors (IGBTs) or switching thyristors (integrated gate commutated thyristors (IGCTs)). The level of the resulting output voltage and also the frequency thereof can be regulated within wide limits. In order to be able to brake, simple frequency converters comprise a so-called brake chopper which conducts the excess energy from the intermediate circuit to a brake resistance and there converts it into heat. The intermediate circuit voltage would otherwise rise and destroy the capacitors. However, there are also more expensive frequency converters with feedback capability which can feed the received, generator-derived brake power back into the power mains. Moreover, there are direct converters (so-termed matrix converters) in which each power mains phase can be directly connected with each phase of the load by way of semiconductor switches. The intermediate circuit with the same magnitude is thus redundant. A direct converter with thyristors can, however, produce only output frequencies lower than the input frequency. Intermediate circuit converters and direct converters with IGBTs, thereagainst, can also produce output frequencies lying above the input frequency. Direct converters similarly have feedback capability. Frequency converters produce strong electrical interference signals on the motor feed line, which not only can disturb other loads, but also lead to increased loading of insulation in the motor. The motor feed is often shielded for avoidance of disturbing signals. A so-termed sine filter between converter and motor can also create a remedy. Such sine filters are distinguished from a mains filter by their lower limit frequency and higher load-bearing capability.

If the frequency converter is in a position of also transferring, in both rotational directions, energy from the intermediate circuit to the motor and during braking also back into the intermediate circuit, then this is known as four-quadrant operation. Since the intermediate circuit can, due to its construction, store only a certain amount of energy free of disturbance, measures for reduction of the stored energy have to be undertaken. A variant which is most frequently used in lower cost frequency converters is the conversion of the electrical energy into thermal energy by the so-termed 'brake chopper', namely a brake resistance which is switched on by an electronic switch. However, in the case of larger energy levels this method is not desirable for ecological or economic reasons. For these cases of use there are converters with feedback capability. They can transfer the energy from the intermediate circuit back into the supply mains. At least some forms of motors with frequency converters with feedback capability can thus be operated as generators even in the case of changing rotational speeds. This can be of interest particularly for drives of elevators, escalators and moving walkways.

In some embodiments, the integration of the electronic power unit into the elevator control arrangement overcomes the prejudice that the heat output of the electronic power unit and its emission of interfering influences are too large in order to be arranged together with the elevator control unit in the narrowest space within the chamber of the door frame. Since the waste heat in the elevator shaft is dissipated and the units are skillfully arranged, with utilization of the surrounding components, relative to one another in the elevator control arrangement, an integration can be possible.

In at least some embodiment, the integration of the electronic power unit in the elevator control arrangement has several features. Firstly, costs can be substantially reduced, since cabling of the motor only still has to be connected with the elevator control arrangement and the elevator control arrangement with the electrical power supply mains. In addition, a separate power supply line between the elevator control arrangement and the power supply mains is not necessary, since the power supply unit of the elevator control arrangement supplies the elevator control unit and the electronic power unit. Secondly, already at the end of the factory assembly of the elevator control arrangement the elevator control unit and the electronic power unit can be matched and adjusted to one another. Moreover, the entire elevator control arrangement can be checked at the manufacturer. This can mean that complicated adjusting operations at the time of assembly, repair or maintenance of the elevator installation are redundant. The entire elevator control arrangement and thus the elevator control unit and the electronic power unit can be exchanged by a few actions.

The elevator control arrangement is possibly also accessible from the elevator shaft. In order to achieve this, the door frame can include in the region of the chamber an opening oriented towards the elevator shaft. The elevator control arrangement comprises a main carrier at which the elevator control unit and the electronic power unit are arranged. In the installed state the opening is closed by the main carrier. The opening has to be closed so that no gases from fire can penetrate and in the case of fire the fire does not propagate via the elevator shaft and the opening in the door frame into the stories.

In order that, in this physically narrow chamber of the door frame, the elevator control arrangement does not overheat and this does not lead to faulty functioning of the elevator control unit, to more rapid ageing or even to destruction of the electronic components, at least the waste heat of the electronic power unit should be dissipated from the chamber. This usually cannot be carried out by way of the door frame itself, since this would otherwise heat up. Through the dissipation of the waste heat into the elevator shaft the door frame has approximately room temperature and the user is not disquieted by a heated door frame. The waste heat of the elevator control unit can also be dissipated into the elevator shaft.

The chamber possibly has electrically conductive chamber walls which are part of the mutual shielding of electrical and/or magnetic fields and electrical and/or magnetic waves of the elevator control unit and the electronic power unit. If the door frame is made of an electrically conductive tubular section, this is the case already. In a given case, shielding plates have to be arranged in the chamber if one side of the chamber is bounded by the masonry of the building.

In order to discharge the waste heat of the electronic power unit into the elevator shaft the main carrier has a cooling air shaft formed by walls, wherein the cooling air shaft connects an induction opening formed at the main carrier with an outlet opening formed at the main carrier. In some embodiments, in the installed state the induction opening and outlet opening of the main carrier are oriented towards the elevator shaft. In addition, the elevator control unit and the electronic power unit are arranged at the walls of the cooling air shaft. At least one wall of the cooling air shaft is of electrically conductive construction and is thereby part of the mutual shielding of the elevator control unit and the power electronic unit from electrical and/or magnetic fields and electrical and/or magnetic waves, which emanate from these units in operation, particularly from the electronic power unit. Parts which serve as shielding are usually electrically conductively connected with earth so that electrostatic charges can also be dissipated.

In further embodiments, at least one of the following units producing waste heat can be arranged at the walls of the cooling air shaft:

- a power supply unit (transformer with DC-AC converter) for power supply of the elevator control unit,
- a power supply unit for power supply of batteries and
- a further electronic power unit, for example for feedback of the electrical energy, which is produced by the elevator motor, to a power supply mains.

The second electronic power system can be used when, for example, the first electronic power system does not have feedback capability or the recuperated electrical energy thereof is utilized for charging batteries. The braking energy of the elevator motor is thus not simply converted by means of heat resistances into heat, but is utilized. Units mentioned in the foregoing similarly produce considerable amounts of waste heat in the narrow chamber, so that the waste heat thereof also can be dissipated via the cooling air shaft into the elevator shaft. Moreover, at least one wall of the cooling air shaft is of electrically conductive construction and is part of the mutual shielding of the elevator control unit and the units producing waste heat. Part of the mutual shielding signifies that the conductive wall of the cooling air shaft contributes to shielding of the electromagnetic interference influences of the respective other units, but that this is not necessarily managed completely. Through skillful arrangement of the elevator control unit and the electronic power units at the walls it is possible, however, to also achieve complete or nearly complete shielding by the walls of the cooling air channel. By "unit" there is not necessarily meant a physical unit; for example, an electronic power unit, a power supply unit or the elevator control unit can also comprise several circuit boards connected together by connecting lines and equipped with electronic components. The term "unit" thus refers to the function of a component or a group of components.

One possibility of efficiently using the walls of the cooling air shaft for the shielding consists in that at least one step is formed at at least one wall of the cooling air shaft. In each instance only the elevator control unit or only an electronic power unit is arranged on a step. Through the stepping of the wall or the walls, regions of the ventilation channel protrude between the units and thereby form a part of the shielding. The number of additional shielding covers, shielding plates and shielding hoods can thereby be minimized and, as well, possible gaps and holes in the shielding, which reduce the shielding capability thereof.

In order to efficiently introduce the waste heat of the electronic power unit and/or the elevator control unit into the cooling air shaft and deliver it there to the throughflowing cooling air, passages can be arranged in the walls. The cooling bodies of components of the electronic power unit and/or the elevator control unit extend through these passages into the cooling air shaft. In order to hamper the passage of fire gases already mentioned further above, the passages can be gastightly closed by the boards of the electronic power unit and/or the elevator control unit.

In order to utilize the discharge of waste heat through the cooling air shaft, at least one electronic power unit can be arranged in the cooling air shaft. In addition, the elevator control unit can be arranged at a side, which is remote from the cooling air shaft, of a wall, wherein the wall of electrically conductive construction is arranged between the at least one electronic power unit and the elevator control unit. The cooling air shaft thereby shields the elevator control unit completely from the disturbing influences of the electronic power unit.

In some embodiments, the electronic power unit and/or the elevator control unit can be covered by an electrically conductive shielding cover, a shielding hood or several shielding hoods, so that they are completely enclosed by electrically conductive parts. An exception can be cooling bodies which protrude into the cooling air channel and which for the purpose of optimum heat dissipation should be in contact with the cooling air flow. The electrically conductive walls can obviously be made of sheet steel, aluminum or a soft-magnetic nickel/iron alloy of high magnetic permeability or coated with these materials.

The walls possibly have a high thermal conductivity. These can then serve as cooling bodies if they are connected with the heat-producing electronic components of the electronic power unit and/or the elevator control unit. In a given case, it is possible to dispense with additional cooling bodies and the openings required for that purpose in the walls. Since the walls of such a cooling air shaft are heated, cooling ribs are possibly arranged in the interior, which is flowed through by air, of the cooling air shaft.

Insofar as the cooling air shaft has a vertical orientation, a chimney effect, through which the cooling air flows by itself without further measures, can arise due to the heat intake of the electronic power unit. The elevator cage passing the outlet opening and induction opening can, however, significantly impair this automatic cooling air flow and in a given case bring it to a stop. In order to help permanently ensure cooling, a fan can be accordingly arranged in the cooling air shaft.

Since the waste heat of the electronic power unit to be dissipated depends on the power consumption or power output of the elevator motor, the cooling power, which is to be exerted, of the cooling air shaft and the fan possibly also varies. In order to reduce the output of noise, two fans can accordingly be arranged in parallel in the cooling air shaft, wherein depending on the respective heat to be dissipated one fan or both fans is or are in operation. Moreover, the cooling air shaft can also be divided into, for example, two channels so that the first fan urges the cooling air through the first channel and the second fan urges the cooling air through the second channel. Such a splitting up can be feasible if, for example, two electronic power units are integrated in the elevator control arrangement.

Moreover, a temperature sensor can be arranged in the electronic power unit and/or in the elevator control unit, wherein the signals of the temperature sensor serve for control and regulation of the fan or the fans.

As mentioned further above, a passing elevator cage can substantially impair the cooling air flow in the cooling air shaft and this can happen even when a fan is present. In order to avoid back pressures of the cooling air, the induction opening and the outlet opening can have flow guide plates which for the purpose of assisting the cooling air flow in the cooling air shaft are oriented towards the travel direction of an elevator cage travelling in the elevator shaft. Through the orientation of the flow guide plates the air from the elevator shaft is forced back into the induction opening or sucked out of the outlet opening when the elevator cage passes.

An elevator shaft closure of a building comprises, as mentioned in the foregoing, a door frame, which is fastened in the building, with a chamber in which the elevator control arrangement with an integrated frequency converter integrated is disposed. In addition, movable doors are guided at the door frame and also belong to the elevator shaft closure. An elevator installation of a building comprises at least one elevator shaft closure with the elevator control arrangement.

BRIEF DESCRIPTION OF THE DRAWINGS

The disclosed technologies are explained in more detail in the following by way of examples and with reference to the drawings, in which.

DETAILED DESCRIPTION

Figure 1:
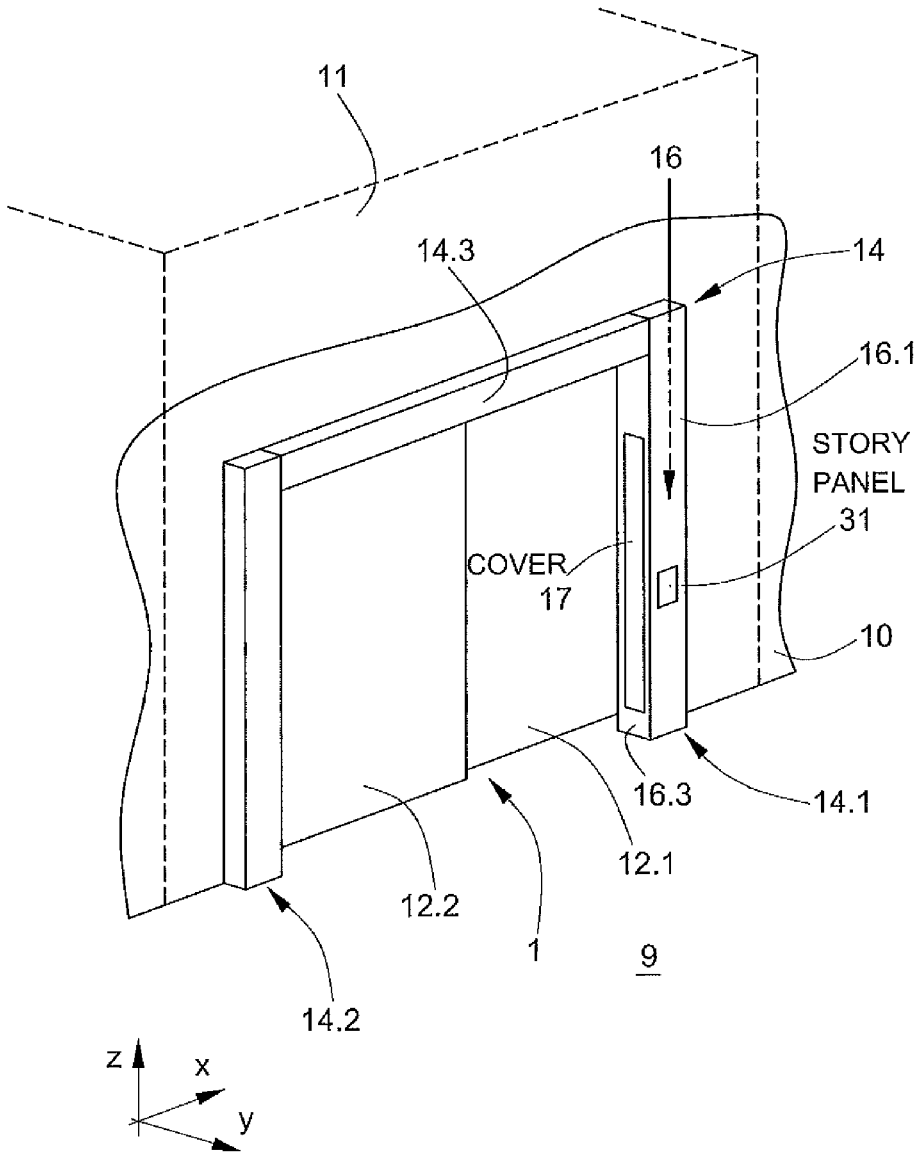
FIG. 1 shows an elevator shaft closure in three-dimensional view with a door frame and an exemplary embodiment of an elevator control arrangement arranged in a chamber of the door frame.

An elevator shaft closure 1 of an elevator installation is illustrated in FIG. 1 in the way in which it can be perceived by a user of the elevator installation on a story 9. A building, which is not illustrated in more detail and in which the elevator installation is disposed, comprises a building wall 10 which is bounded by an elevator shaft 11 indicated by dashed lines.

The elevator shaft 11 is separated from the story 9 by the elevator shaft closure 1. The elevator shaft closure comprises a shaft door which consists substantially of two door panels 12.1, 12.2 and a door frame 14. The door panels 12.1, 12.2 are horizontally displaceable and, in particular, in the direction of an axis X of an orthogonal three-dimensional co-ordinate system, which is shown in FIG. 1, with the further axes Y and Z. The door frame 14 comprises three door frame elements, namely two lateral, vertical door frame elements 14.1, 14.2, which form door posts and are oriented parallel to the axis Z, and an upper, horizontal door frame element 14.3, which is oriented parallel to the axis X.

A chamber 16 is formed by the vertical door frame element 14.1 in the interior thereof. The vertical door frame element 14.1 comprises a plurality of post walls, in particular an outer front post wall 16.1 and an outer lateral post wall 16.3. In the present exemplifying embodiment the outer front post wall 16.1 lies parallel to a plane formed by the axes X and Z and the outer lateral post wall 16.3 lies parallel to a plane formed by the axes Y and Z. The outer front post wall 16.1 and the outer lateral post wall 16.3 face the story 9. Inner post walls, which are explained in more detail in connection with FIGS. 2 and 3, can be present additionally to the outer post walls 16.1 and 16.3.

The outer lateral post wall 16.3 has an outer opening enabling access to the chamber 16. This outer opening can be of any desired suitable size, in particular it can extend over the major part of the lateral post wall 16.3, as is indicated in FIG. 1. The outer opening can also be formed in the outer front post wall 16.1.

The outer opening is closable by a cover 17. If the elevator installation is operationally ready or in operation, then the cover 17 is mounted in its operating position in which it closes the outer opening. If the elevator installation is being serviced, then the cover 17 is in a servicing position, in which case it is completely demounted, i.e. out of contact with the door frame element 14.1. Alternatively, the cover 17 can also be fastened to the door frame element 14.1 by means of a hinge. The cover 17 is possibly let into the outer opening to be flush by its outer surface, whereby it can be fastened to be generally vandal-proof and can offer an aesthetically satisfying appearance.

The outer front post wall 16.1 contains a passage in which a story control panel 31 is mounted, wherein possibly the same story control panel 31 can be used on all stories of the elevator installation. The story panel 31 can also be let into the cover 17. The story panel 31 can comprise simple upward/downward selection buttons, a destination call control, a user identification reader, a touch-shield with a graphical user surface and more of the like.

Figure 2:
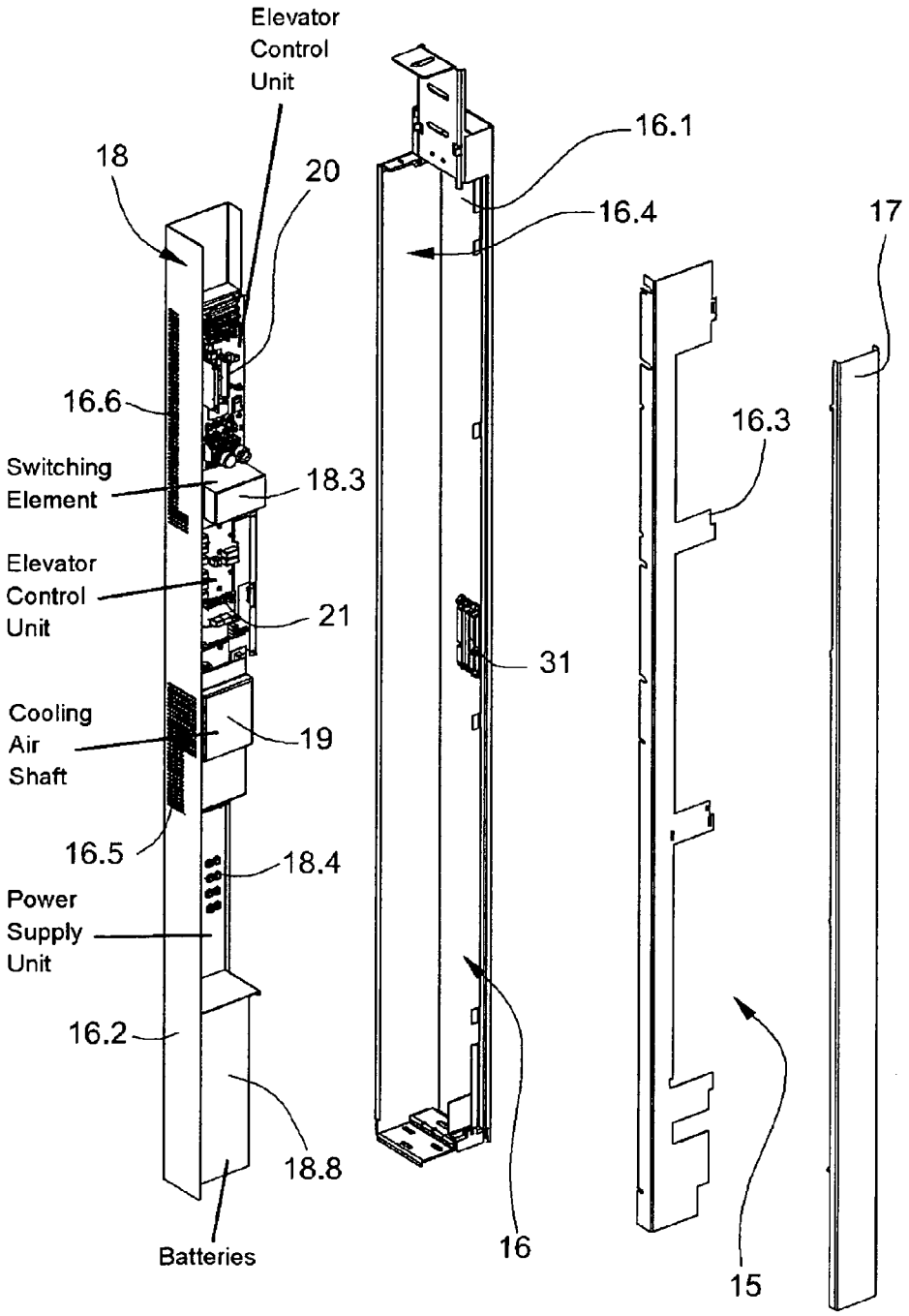
FIG. 2 shows door post parts of the door frame of FIG. 1 in three-dimensional exploded illustration, which form the chamber, as well as the elevator control arrangement.

FIG. 2 shows door post parts of the door frame 14 of FIG. 1 in three-dimensional exploded illustration. The features already described in FIG. 1 have the same reference numerals. In FIG. 2 the viewing direction is directed onto the door posts not from the story 9, but from the elevator shaft 11. The outer front post wall 16.1 is therefore to be seen from behind. Equally, the story panel 31 can be seen from behind. The outer lateral post wall 16.3 is connected with the outer front post wall 16.1 and the outer opening 15 thereof is closed by the cover 17. The outer front post wall 16.1 is formed by means of folding over an inner lateral post wall 16.4. This inner lateral post wall 16.4 is oriented towards the masonry of the building wall 10 when the door frame 14, as illustrated in FIG. 1, is let into the masonry opening of the building wall 10. By virtue of this construction, by which the door frame 14 has in the region of the door post a U-shaped cross-section, the chamber 16 has an opening directed towards the elevator shaft 11. This opening, or the chamber 16 formed by the door post parts 16.1, 16.3 and 16.4, is closed by a main carrier 16.2 of an elevator control arrangement 18. Remaining parts of the elevator control 18 are arranged on the main carrier 16.2 in such a manner that in the installed state this is located within the chamber 16. If the elevator control arrangement 18 has to be exchanged, it can be completely demounted from the side of the elevator shaft 11 by detaching the main carrier 16.2 from the post walls 16.1, 16.3 and 16.4. For this purpose, the elevator cage (not illustrated) can be moved to a suitable height between two stories 9 so that an operator standing or crouching on the roof of the elevator cage or on a work surface of the elevator cage can perform the necessary work.

The control arrangement 18 comprises substantially the following subassemblies:

- the main carrier 16.2,
- an elevator control unit 20 fastened to the main carrier 16.2,
- an electronic power unit 21, which is fastened to the main carrier 16.2, for operation of an elevator motor (feed and optionally feedback),
- an optional second electronic power system for feedback of the electrical energy produced by the elevator motor,
- a power supply unit 18.4 for power supply of the elevator control unit 20 and/or batteries 18.8,
- means for cooling the units 20, 21 generating waste heat, wherein the waste heat is dissipated into the elevator shaft 11,
- optionally one or more switching elements 18.3, for example a circuit breaker,
- fastening means for installation of the main carrier 16.2 and the chamber 16,
- cable for power supply and for producing connections with the story control panels and for connection with the elevator motor,
- an optional electrical or electromagnetic monitoring of the cover 17
- as well as an optional illumination of the chamber 16,
- shielding means, such as shielding covers, shielding plates or shielding hoods,
- apparatus used for emergency evacuation, for example batteries 18.8.

In further embodiments, the elevator control unit 20 comprises the following elements:

- hardware and software of the elevator control (for example, a main computer with logic elements and interfaces),
- tele-alarm system and/or intercom (for example in order to be able to place a service or emergency call).

Various means can be employed for dissipation of the waste heat into the elevator shaft 11. For example, through a skillful selection and arrangement of the units 20, 21 the waste heat can be transferred to the main carrier 16.2, which in turn delivers the waste heat to the air in the elevator shaft 11. If the cooling output of the main carrier 16.2 should be insufficient, the main carrier illustrated in FIG. 2 has an induction opening 16.5 and an outlet opening 16.6. These are interconnected by a cooling air shaft 19. The cooling air shaft 19 is hardly visible in FIG. 2, since the units of elevator control unit 20, electronic power unit 21 and switching element 18.3 generating waste heat are arranged at the walls thereof.

Figure 3:
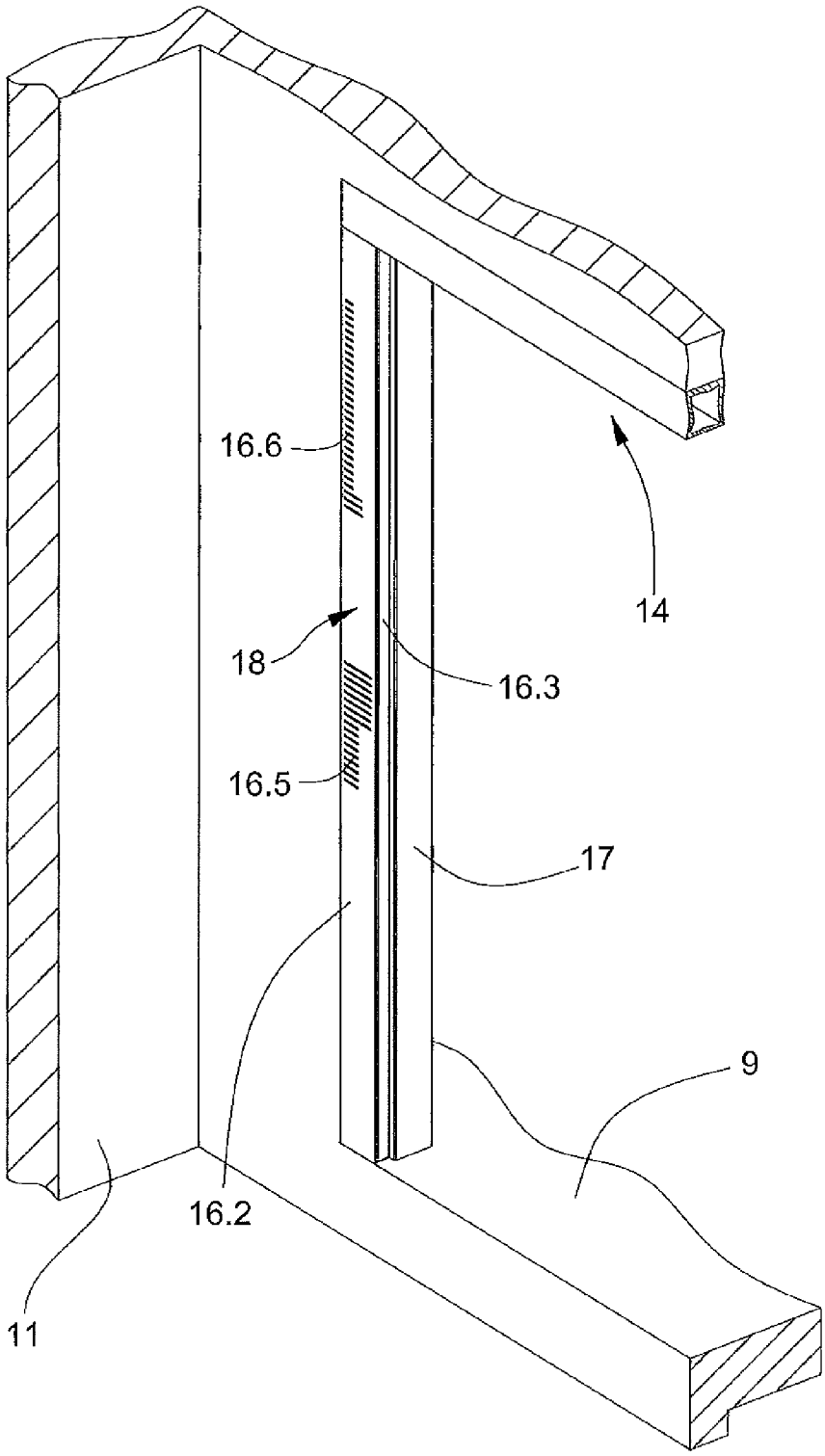
FIG. 3 shows the door frame in three-dimensional view with viewing direction from the elevator shaft onto the story, the door posts of which include the door post parts shown in FIG. 2, and the elevator control arrangement.

FIG. 3 shows the door frame 14 in three-dimensional view with a viewing direction from the elevator shaft 11 onto the story 9. The door posts of the door frame 14 include the door post parts 16.1, 16.3, 16.4 shown in FIG. 2, the cover 17 and the elevator control arrangement 18. For preservation of clarity, illustration of the door panel separating the story 9 from the elevator shaft 11 when no cage is disposed in the region of the elevator shaft closure has been dispensed with. In FIG. 3 the arrangement of the induction opening 16.5 and the outlet opening 16.6 in the main carrier 16.2 one above the other can be readily seen. Through this arrangement an air flow produced by chimney effect arises in the cooling air shaft (not visible).

Figure 4:
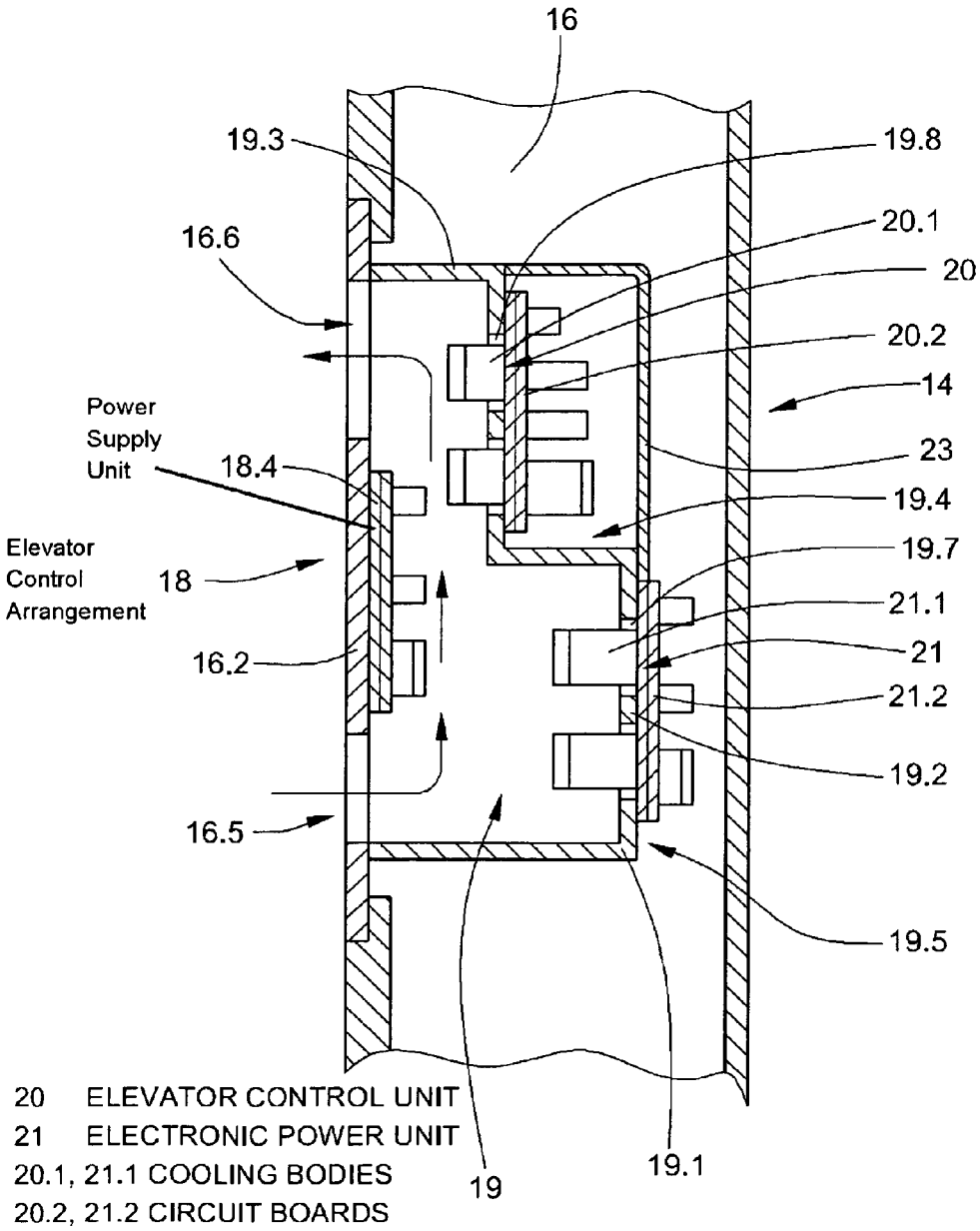
FIG. 4 shows, in sectional elevation view, an elevator control arrangement installed in the chamber of the door frame, in an embodiment without fan.

An elevator control arrangement 18 incorporated in the chamber 16 of the door frame 14 is illustrated in a first embodiment in FIG. 4 in a sectional elevation. An induction opening 16.5 and an outlet opening 16.6 are formed at the main carrier 16.2 of the elevator control arrangement 18. A cooling air shaft 19 connecting the induction opening 16.5 with the outlet opening 16.6 is formed by means of walls 19.1, 19.2, 19.3 on the side of the main carrier 16.2 facing the chamber 16. The first wall 19.2 arranged parallel to the main carrier 16.2 is of stepped construction, wherein an elevator control unit 20 is arranged on the first step 19.4 and an electronic power unit 21 on the second step 19.5. In addition, a power supply unit 18.4 is arranged within the cooling air shaft 19. The elevator control unit 20 and the electronic power unit 21 comprise circuit boards 20.2, 21.2 on which the individual electronic components are arranged. Some of these electronic components have cooling bodies 20.1, 21.1, which extend into the elevator shaft 19 via passages 19.7, 19.8 in the first wall 19.2. In some cases, the circuit boards 20.2, 21.2 completely cover the passages 19.7, 19.8 so that the cooling air shaft 19 is separated gas-tight from the chamber 16.

Since the main carrier 16.2 and the walls 19.1, 19.2, 19.3 of the cooling air shaft 19 are, for the purpose of shielding the elevator control unit 20 and the electronic power unit 21, made of metal in a given case the circuit boards 20.2, 20.3 thereof have to be arranged at a spacing from the main carrier 16.2 and the walls 19.1, 19.2, 19.3. The gas-tightness can be achieved by means of sealing elements (not illustrated) such as sealing strips, sealing cords, hardenable sealing masses or flat seals. Tightness can, however, also be achieved by further shielding means, for example, a shielding hood 23, such as by way of example covers the elevator control unit 20 in FIG. 4. Means serving for shielding should be electrically conductively interconnected. Possibly, these are also earthed.

The waste heat is transferred by thermal convection from the cooling bodies 20.1, 21.1 to the air in the cooling shaft 19. The heated air rises in the cooling air shaft 19 towards the outlet opening 16.6 and thereby inducts cool air into the cooling air shaft 19 via the induction opening 16.5. In order that a strong air flow in the cooling air shaft is produced, possibly—as illustrated—the units with the largest output, for example the electronic power unit 21, are arranged in the vicinity of the induction opening 16.5.

Figure 5:
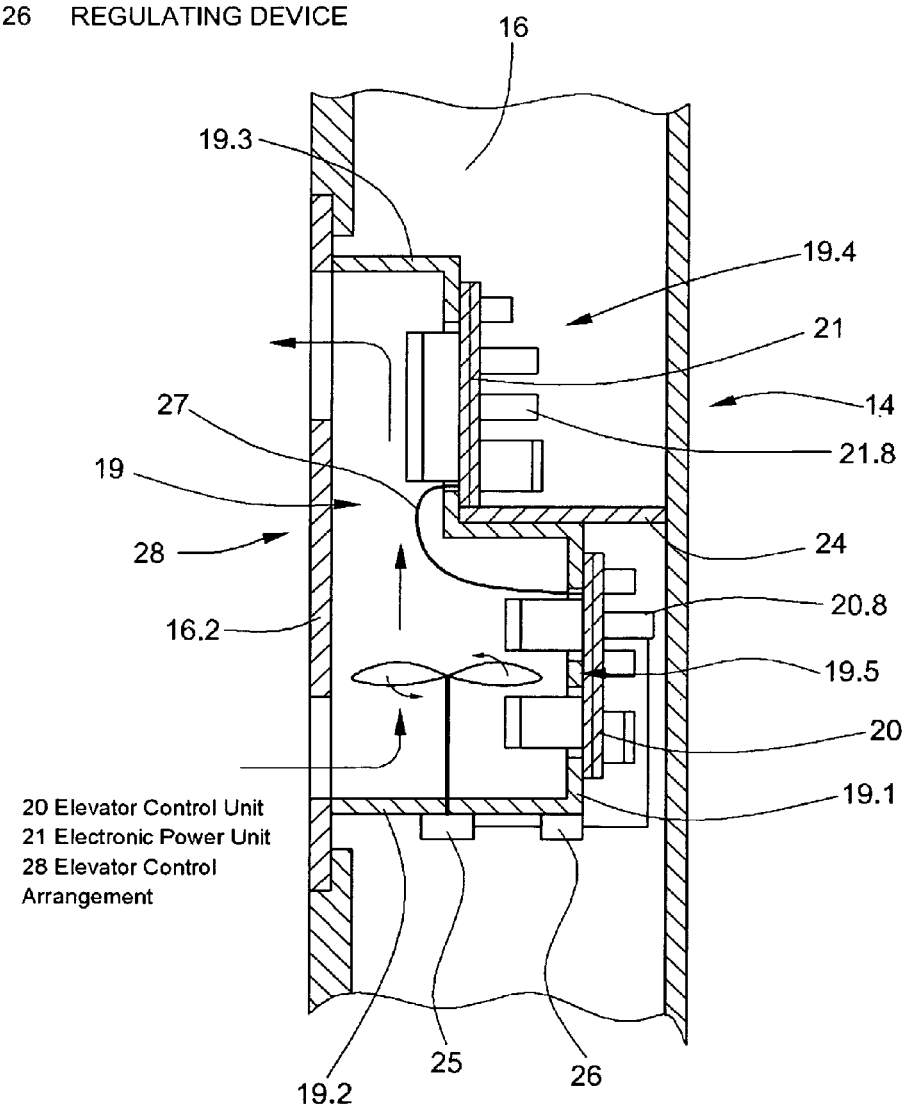
FIG. 5 shows, in sectional elevation view, an elevator control arrangement installed in the chamber of the door frame, in an embodiment with a fan and with temperature sensors for regulation of the fan.

FIG. 5 also shows, in sectional elevation, an elevator control arrangement 28 installed in the chamber 16 of the door frame 14 in another embodiment. The main carrier 16.2 of this elevator control arrangement 28 almost corresponds in terms of construction with the main carrier 16.2 of FIG. 4, for which reason the same reference numerals are used for this and the cooling air shaft 19 as well as the chamber 16. In addition, in this exemplifying embodiment the first wall 19.1 is of stepped construction, wherein an electronic power unit 21 is arranged on the first step 19.4 and an elevator control unit 20 is arranged on the second step 19.5. In addition, a fan 25 is arranged in the cooling air shaft 19. Whether the fan motor is arranged within the cooling air shaft 19 or, as illustrated, in the chamber 16 depends on whether the fan motor has to be cooled and which installation position causes the smallest amount of noise.

The use of a fan 25 makes it possible to determine the sequence of units 20, 21 should be cooled first. In the present exemplifying embodiment it is the more temperature sensitive elevator control unit 20. A respective temperature sensor 20.8, 21.8 is arranged in the region of each of the electronic power unit 21 and the elevator control unit 20 in order to monitor the operating temperatures of these units 20, 21. The signals thereof are fed to a regulating device 26, which regulates the rotational speed of the fan motor.

Since the door frame 14, the main carrier 16.2 and the walls 19.1, 19.2, 19.3 of the cooling air shaft 19 are made of metal, it is usually necessary for shielding to arrange only one shielding plate 24 between the electronic power unit 21 and the elevator control unit 20 to be as free of any gap as possible. Since no circuit boards with interference sensitive electronic elements are arranged in the cooling air shaft 19, the connecting lines 27, which connect the units 20, 21 together, can be led through the cooling air shaft 19 so that the shielding thereof is effected by the walls 19.1, 19.2, 19.3.

Figure 6:
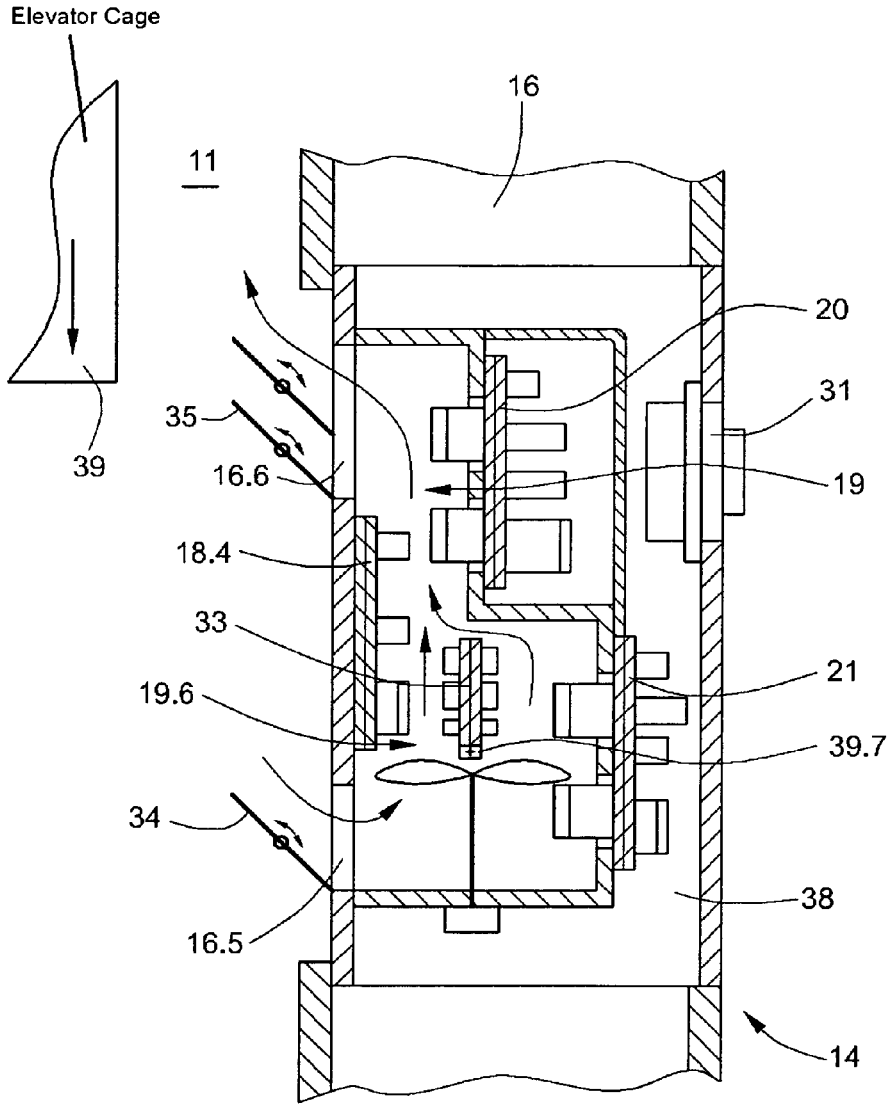
FIG. 6 shows, in sectional elevation view, an elevator control arrangement installed in the chamber of the door frame, in an embodiment with flow guide plates in the elevator shaft.

A further embodiment of an elevator control arrangement 38 installed in the chamber 16 of the door frame 14 is illustrated in FIG. 6 in sectional elevation. This embodiment also substantially corresponds with the two exemplifying embodiments described in the foregoing with an elevator control unit 20, a first electronic power unit 21 and a power supply unit 18.4. For this reason only the differences are discussed in the following. The first difference consists in the installation concept of the elevator control arrangement 38 in the chamber 16. The elevator control arrangement 38 is conceived as a push-in module which can be installed or demounted from the story side. For this reason the story control panel 31 is also integrated in the elevator control arrangement 38. In addition, as illustrated, a second electronic power unit 33 can be arranged centrally in the cooling air shaft 19, whereby the two flat sides of the second electronic power unit 33 are flowed around by cooling air. The second electronic power unit 33 can obviously also be arranged in any position in the cooling air shaft 19, usually subject to the condition that the throughflow of cooling air is guaranteed. It is also relevant to this arrangement variant that the second electronic power unit is arranged at the wall of the cooling air shaft 19, since the circuit board of the second electronic power unit 33 is fastened at the end face by screws 39.7 to a fourth wall 19.6 of the cooling air shaft 19.

The third difference relates to the arrangement of flow guide plates 34, 35 in the elevator shaft 11. As illustrated, not only the outlet opening 16.6, but also the induction opening 16.5 can be equipped with these. Generally, also only one of the two openings 16.5, 16.6 can have flow guide plates 34, 35. These are arranged to be pivotable and are oriented towards the flow conditions, which prevail in the elevator shaft in the region of the openings 16.5, 16.6 when an elevator cage 39 passes these. The orientation of the flow guide plates 34, 35 has the objective that the air flow, which is indicated by arrows, in the cooling air shaft 19 always has the same flow direction. The flow guide plate 34 of the induction opening 16.5 can be pivoted independently of the flow guide plates 35 of the outlet opening 16.6. In a given case the outlet opening 16.6 and/or the induction opening 16.5 can also be temporarily closed by the flow guide plates 34, 35.

Figure 7:
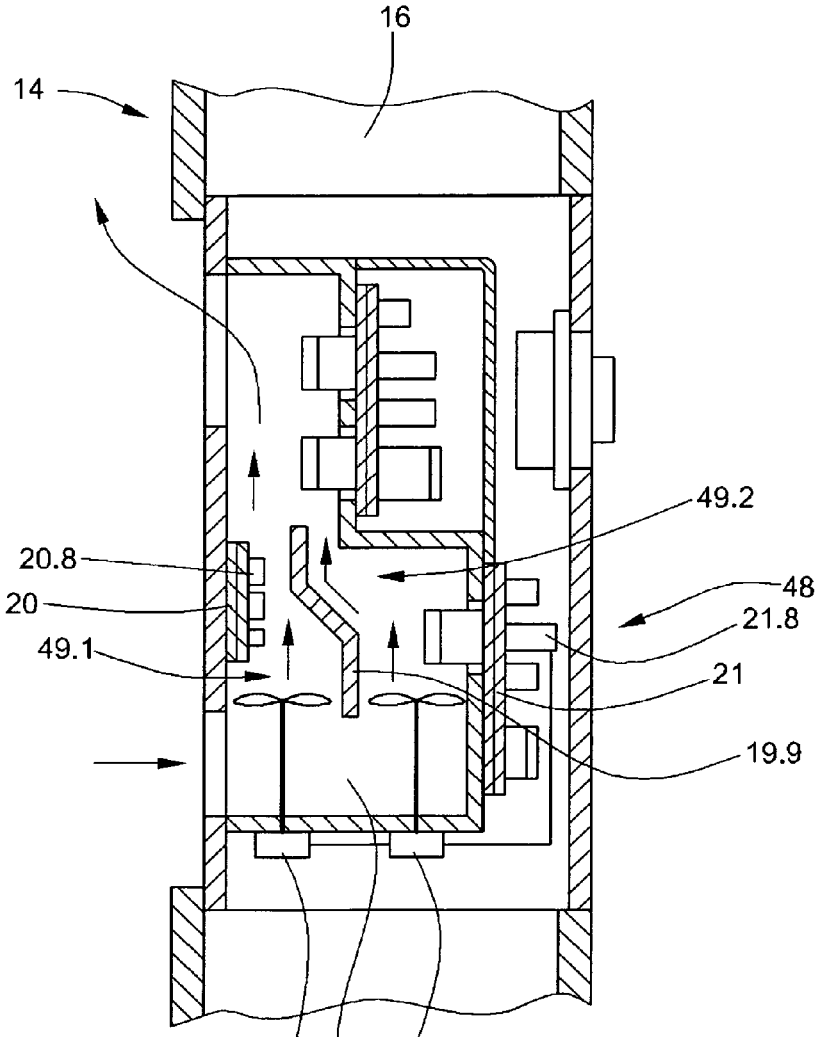
FIG. 7 shows, in sectional elevation view, an elevator control arrangement installed in the chamber of the door frame, in an embodiment with two fans and a cooling air shaft subdivided into two channels.

FIG. 7 shows in sectional elevation an elevator control arrangement 48, which is installed in the chamber 16 of the door frame 14, in a fourth embodiment. This has a cooling air shaft 49 which is subdivided by an intermediate wall 19.9 into a first channel 49.1 and a second channel 49.2. A first fan 45 is arranged in the first channel 49.1 and a second fan 46 is arranged in the second channel 49.2. This subdivision of the cooling air shaft 48 allows a selective cooling of the units 20, 21 generating waste heat. In addition, the output of noise can be substantially reduced by this subdivision, since the rotational speeds of the two fans 45, 46 can be regulated independently of one another appropriately to requirements. Possibly, the elevator control unit 20 and the electronic power unit 21 accordingly have a temperature sensor 20.8, 21.8, the signals of which are used for regulating the corresponding fans 45, 46.

Although the disclosed technologies have been described by the illustration of specific exemplifying embodiments, other variants of embodiment can be created with knowledge of the present disclosure, for example in that the features of the individual exemplifying embodiments are combined with one another and/or individual functional units of the exemplifying embodiments are interchanged. For example, flow guide plates can be present in all exemplifying embodiments or the cooling air shafts can have several channels. Correspondingly, in all exemplifying embodiments two or even more fans are usable. The cooling air shaft can obviously also be arranged obliquely or orthogonally to the travel direction of the elevator cage when the space conditions in the door frame permit this.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

I claim:

1. A door frame for an elevator shaft closure, the elevator shaft closure being for separating an elevator shaft from a building story, the door frame comprising:

a chamber;

an opening arranged to be directed toward the elevator shaft; and an elevator control arrangement arranged in the chamber, the elevator control arrangement comprising, a main carrier, the main carrier being configured to close the opening, an elevator control unit arranged at the main carrier, and an electronic power unit connectible with an elevator motor, the electronic power unit being arranged at the main carrier, wherein the main carrier comprising a cooling air shaft, the cooling air shaft being defined by a plurality of walls, the cooling air shaft connecting an induction opening formed at the main carrier with an outlet opening formed at the main carrier, the induction opening and the outlet opening being for directing toward the elevator shaft, the elevator control unit and the electronic power unit being arranged at the plurality of walls of the cooling air shaft.

2. The door frame of claim 1, the electronic power unit being part of a frequency converter.

3. The door frame of claim 1, the chamber comprising an electrically conductive chamber wall, the electrically conductive chamber wall providing electrical or magnetic mutual shielding of the elevator control unit and the electronic power unit.

4. The door frame of claim 1, the main carrier comprising at least one of the plurality of walls providing electrical or magnetic mutual shielding of the elevator control unit and the waste-heat-producing unit.

5. The door frame of claim 4, further comprising a waste-heat-producing unit arranged at the plurality of walls of the cooling shaft, at least one of the plurality of walls providing electrical or magnetic mutual shielding of the elevator control unit and the waste-heat-producing unit.

6. The door frame of claim 5, the waste-heat-producing unit comprising a power supply unit for the elevator control unit.

7. The door frame of claim 5, the waste-heat-producing unit comprising a power supply unit for batteries.

8. The door frame of claim 5, the waste-heat-producing unit comprising an additional electronic power unit.

9. The door frame of claim 4, further comprising a step formed on at least one of the plurality of walls, only the electronic power unit or only the elevator control unit being arranged on the step.

10. The door frame of claim 4, at least one of the plurality of walls comprising a passage for receiving into the cooling air shaft a cooling body of the electronic power unit or a cooling body the elevator control unit.

11. The door frame of claim 10, the passage being sealed air-tight by a circuit board of the electronic power unit or the elevator control unit.

12. The door frame of claim 4, the electronic power unit being arranged in the cooling air shaft, and the elevator control unit being arranged at a side of a wall remote from the cooling air shaft.

13. The door frame of claim 4, the electronic power unit or the elevator control unit being at least partially covered by an electrically conductive shielding cover, the electrically conductive shielding cover being electrically connected with the at least one of the plurality of walls providing electrical or magnetic mutual shielding.

14. The door frame of claim 4, further comprising a fan arranged in the cooling air shaft.

15. The door frame of claim 14, further comprising a temperature sensor arranged in the electronic power unit or the elevator control unit and coupled to the fan.

16. The door frame of claim 4, further comprising induction opening flow guide plates and outlet opening flow guide plates, the induction opening flow guide plates and the outlet opening flow guide plates being oriented according to a travel direction of an elevator cage in the elevator shaft.

17. An elevator shaft closure for an elevator shaft of a building, the elevator shaft closure comprising:

a movable door; and a door frame, the door frame comprising, a chamber, an opening arranged to be directed toward the elevator shaft, and an elevator control arrangement arranged, in the chamber, the elevator control arrangement comprising, a main carrier, the main carrier being configured to close the opening, an elevator control unit arranged at the main carrier, an electronic power unit connectible with an elevator motor, the electronic power unit being arranged at the main carrier, wherein the main carrier comprising a cooling air shaft, the cooling air shaft being defined by a plurality of walls, the cooling air shaft connecting an induction opening formed at the main carrier with an outlet opening formed at the main carrier, the induction opening and the outlet opening being for directing toward the elevator shaft, the elevator control unit and the electronic power unit being arranged at the plurality of walls of the cooling air shaft.

18. An elevator installation, comprising:

a car disposed in a shaft of a building; and a door frame for separating the shaft from a story of the building, the door frame comprising, a chamber, an opening arranged to be directed toward the shaft, and an elevator control arrangement arranged in the chamber, the elevator control arrangement comprising, a main carrier, the main carrier being configured to close the opening, an elevator control unit arranged at the main carrier, and an electronic power unit connectible with an elevator motor, the electronic power unit being arranged at the main carrier wherein the main carrier comprising a cooling air shaft, the cooling air shaft being defined by a plurality of walls, the cooling air shaft connecting an induction opening formed at the main carrier with an outlet opening formed at the main carrier, the induction opening and the outlet opening being for directing toward the elevator shaft, the elevator control unit and the electronic power unit being arranged at the plurality of walls of the cooling air shaft.

* * * * *